United States Patent [19]

Ward et al.

[11] Patent Number: 4,806,036

[45] Date of Patent: Feb. 21, 1989

[54] PRINTER MECHANISM CARRIED BY UPPER PORTION OF HINGED HOUSING

[75] Inventors: David O. Ward, Waynesboro; Theodore S. Zajac, Jr., Charlottesville, both of Va.; Frederick B. Hadtke, New Providence, N.J.

[73] Assignee: Genicom Corporation, Waynesboro, Va.

[21] Appl. No.: 106,006

[22] Filed: Oct. 7, 1987

Related U.S. Application Data

[63] Continuation of Ser. No. 797,119, Nov. 12, 1985, abandoned.

[51] Int. Cl.[4] ..... B41J 29/02

[52] U.S. Cl. ..... 400/691; 400/605

[58] Field of Search ..... 400/691-693, 400/605, 616

[56] References Cited

U.S. PATENT DOCUMENTS

| | | | |
|---|---|---|---|
| 2,408,452 | 10/1946 | Stixrnd | 400/680 |
| 3,180,572 | 4/1965 | Gallant | 400/693 |
| 3,722,655 | 3/1973 | Singer | 400/616 |
| 4,330,219 | 5/1982 | Miyaska et al. | 400/691 |
| 4,386,864 | 6/1983 | Wang et al. | 400/691 |
| 4,452,543 | 6/1984 | Adkisson et al. | 400/605 |
| 4,510,345 | 4/1985 | Costa et al. | 400/693 |
| 4,531,852 | 7/1985 | Madge et al. | 400/692 |
| 4,568,211 | 2/1986 | Fox et al. | 400/693 |

FOREIGN PATENT DOCUMENTS

| | | | |
|---|---|---|---|
| 189124 | 7/1986 | European Pat. Off. | 400/693 |
| 116182 | 7/1983 | Japan | 400/691 |
| 204587 | 11/1984 | Japan | 400/693 |
| 44379 | 3/1985 | Japan | 400/605 |
| 1169616 | 11/1969 | United Kingdom . | |

OTHER PUBLICATIONS

Rex "Conventional . . . Demand Printer", IBM Technical Disclosure Bulletin, vol. 25, No. 10, pp. 5170-5171, 3/83.

*Primary Examiner*—William Pieprz

*Attorney, Agent, or Firm*—Nixon & Vanderhye, P.C.

[57] ABSTRACT

A continuous form tractor drive is disposed out of the way and out of sight below the printing platen (which itself may be capable of feeding individual forms to a print station). The mechanical paper handling and printing mechanism is affixed to the upper portion of a hinged housing with the continuous form tractor drive mechanism depending therefrom such that, when rotated upwardly and rearwardly to an opened position, easy access is provided for loading paper into the continuous form paper drive.

22 Claims, 3 Drawing Sheets

PRINTER MECHANISM CARRIED BY UPPER PORTION OF HINGED HOUSING

This is a continuation of application Ser. No 797,119 filed Nov. 12, 1985, now abandoned.

FIELD OF THE INVENTION

This invention generally relates to printers of the type used as computer output devices for printing on continuous form paper and/or for printing on individual paper forms. In particular, it provides an attractive and utilitarian arrangement of the printer parts while yet providing easy access for loading of continuous form paper and viewing of the document as it is being printed.

This application is related to commonly assigned co-pending application Ser. No. 797,121 filed Nov. 12, 1985 and now U.S. Pat. No. 4,761,087.

BACKGROUND AND SUMMARY OF THE INVENTION

Printers which respond to external digital data sources (e.g. a computer system) for printing documents on either continuous or individual paper forms are common in the prior art. These printers generally are designed with improved print speed or accuracy in mind. Some may even include hinged or otherwise movable multi-part housings to improve access for servicing and/or for paper engagement with driving mechanisms or the like. However, there is often a rather cumbersome access arrangement—especially where both individual sheets and continuous (i.e. "fan folded") documents must be accommodated by the same printing device. Typically, the approach has been to provide a continuous form tractor drive located above or generally at the same elevation as the printing platen (which may itself serve to drive single sheet forms through the print station). If such tractor drives have been mounted below the platen in the past, it is believed that access to them for paper loading has been extremely cumbersome.

Now, however, we have discovered an advantageous arrangement for placing the unsightly continuous form tractor drive out of the way below the printing platen—while simultaneously providing ready access for loading continuous form paper into it.

The exemplarly embodiment uses upper and lower printer housings which are hingedly connected toward the lower rear of the lower housing member. The paper drive and printing components are all affixed to the upper housing portion with the continuous form tractor drive depening therefrom such that, when the upper and lower housing portions are rotated to an opened position, there is ready access to the tractor drive for paper loading operations. Preferably, the upper and lower housings are also angularly configured with respect to one another at the rear so as to accommodate the rotational opening movement of the two housing members even though the rotational hinged connection point is not located at the parting line between the two housing structures but, rather, is located toward the lower rear portion of the lower housing member so as to obtain additional opened access space.

The lower housing typically includes an elongated slot for feeding continuous form paper upwardly therethrough and into the continuous form tractor drive mechanism which, in turn, drives the paper further upwardly into contact with the front side of a printing platen at a printing station before passing on out through an elongated exit slot in the upper portion of the upper housing. The same or another elongated opening is also provided in the upper housing (together with suitable paper guiding mechanism) for feeding single form sheets into the rear side of the platen and on around the bottom of the platen to the front side at the printing station and then out the paper exit slot in the upper housing.

BRIEF DESCRIPTION OF THE DRAWINGS

These as well as other objects and advantages of this invention will be better understood by careful study of the following detailed description of the presently preferred exemplary embodiment taken in conjunction with the accompanying drawings, of which.

DETAILED DESCRIPTION

Figure 4:
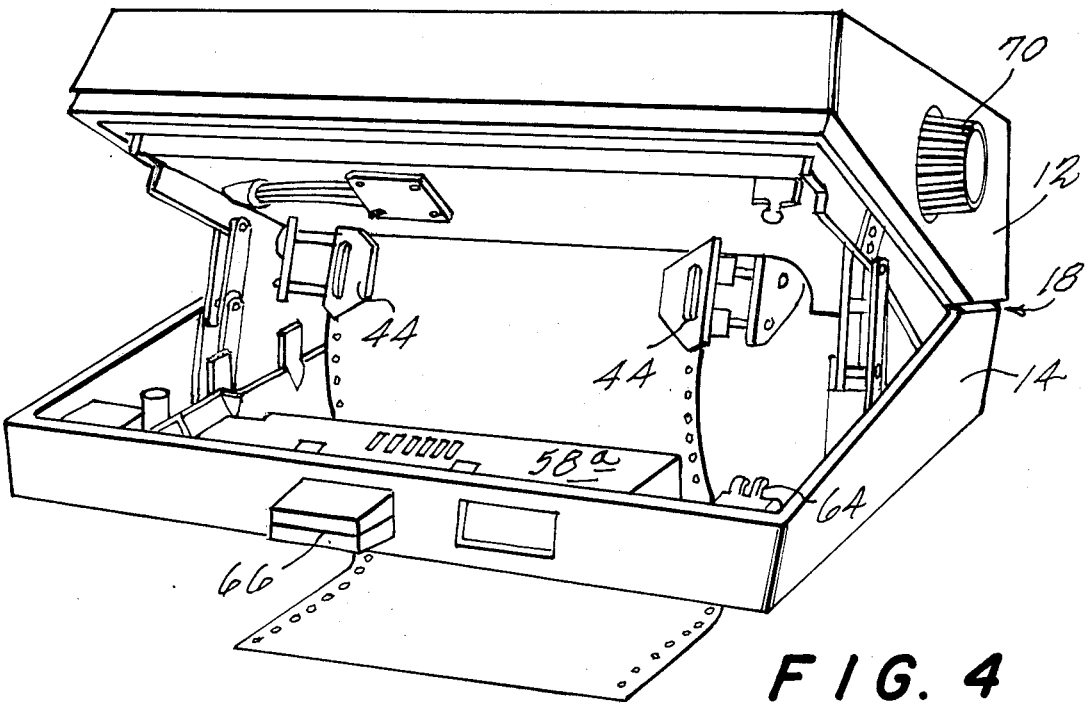
FIG. 4 is a perspective view of the exemplary embodiment when opened for access to the continuous form tractor drive.
Figure 1:
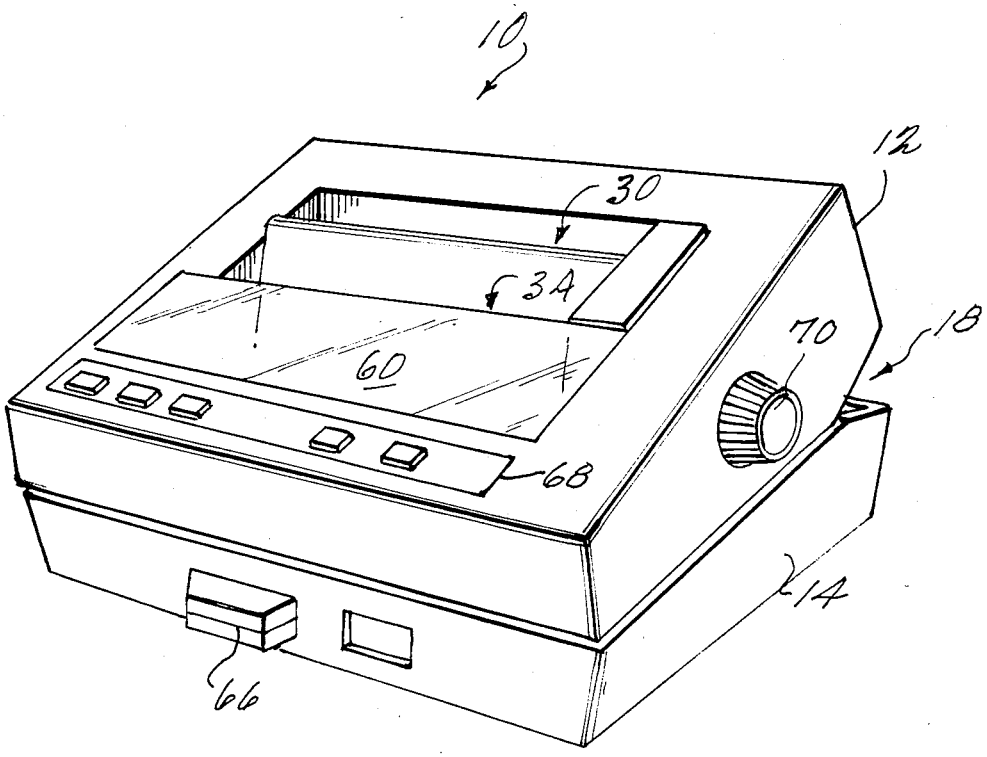
FIG. 1 is a general perspective view of an exemplary embodiment of the printer.

An exemplary embodiment of the printer 10 is depicted at FIGS. 1–4. It generally includes an upper housing member 12 and a lower housing member 14 hingedly connected at 16 near the lower rear portion of the lower housing member 14. A rear portion of the housings include an angular configuration at 18 so as to accommodate a rotational opening motion to the open position shown in FIGS. 3 and 4. As will be observed, in the open position the rear relatively angled portions of the housings 12, 14 fit in abutting relationship. However, rather than to place the rotational connection near the parting line between the upper and lower housings (e.g. near the apex of the angled section 18), the preferred embodiment places the rotatable connection 16 at a lower rear location within the lower housing member 14 thus providing a rearward "over center" type of movement which provides an even wider open mouth in the paper loading access position depicted at FIGS. 3 and 4.

The printer 10 includes the usual rotatable platen 20 which has a print station 22 located at its front side where printed indicia are imparted to a paper surface carried by the front side of the platen. Suitable guides 24, 26 may be conventionally provided for directing individual form sheets 28 input through an entrance slot 30 into engagement with the rear side of the platen 20 such that, upon rotation of the platen, the paper is directed around and past print station 22, under paper bail 32 and out paper exit slot 34. Printing may be performed at print station 22 by any conventional printing mechanism such as, for example, a conventional driven print ribbon 36 and a dot matrix print head 38 which is driven transversely along carriage 40 by conventional carriage drive mechanism 42.

A continuous form tractor drive 44 (of conventional design) is mounted below the platen 20 and includes suitable paper guides 46, 48 so as to pull continuous form fan fold paper 50 or the like through a paper entrance slot 52 in the bottom of the lower housing member 14 and upwardly into engagement with the front side of platen 20 past the print station 22, under bail 32 and through paper exit slot 34. One or more conventional motors may be utilized for individually driving the print head along the carriage, the ribbon with respect to the print head, the platen 20 and the tractor drive 44. In the schematic depiction of FIG. 2, a single motor 54 has been schematically depicted for simplicity.

Figure 2:
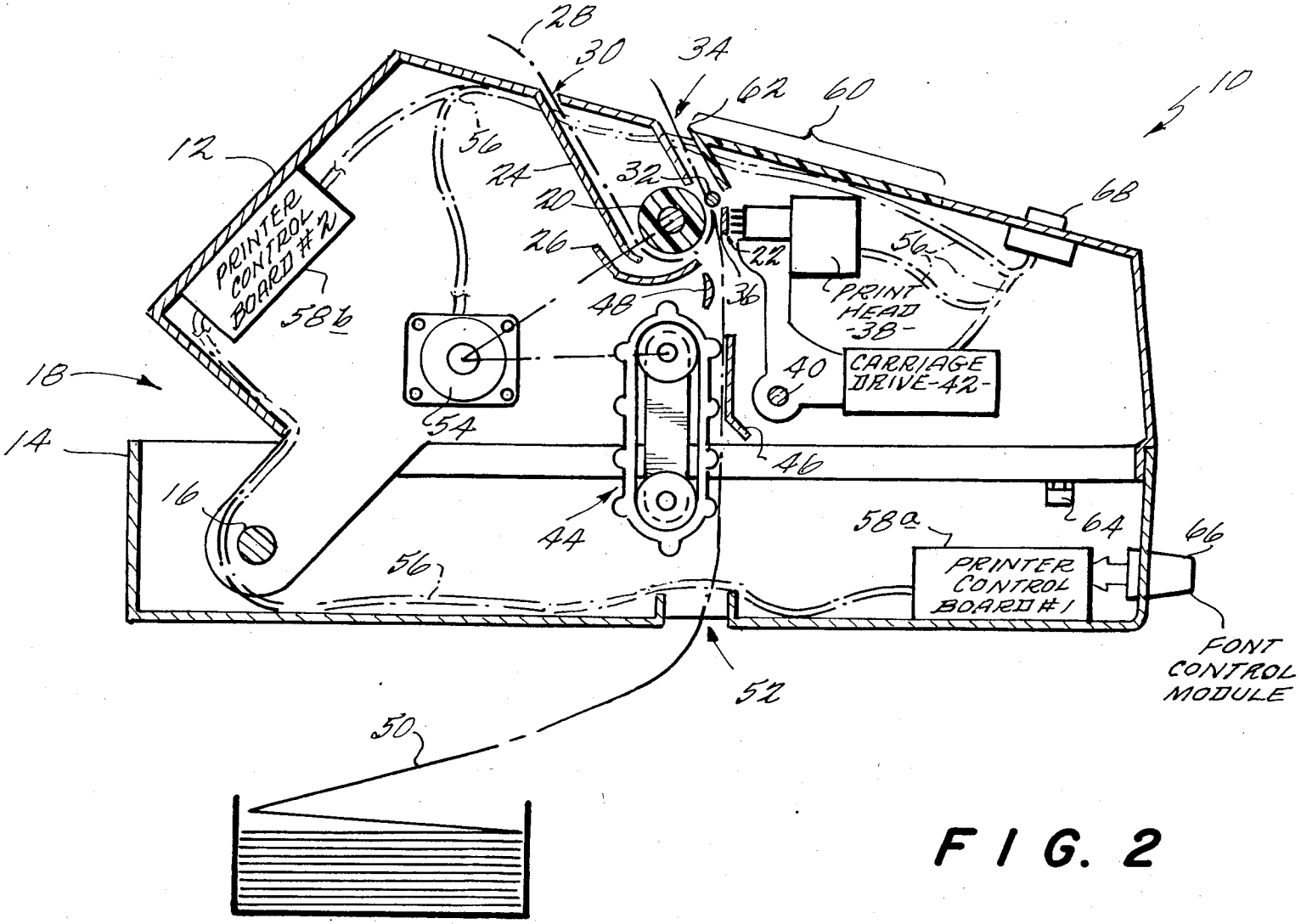
FIG. 2 is a schematic cross-sectional view of the exemplary embodiment generally depicting the relative location of certain printer components.
Figure 3:
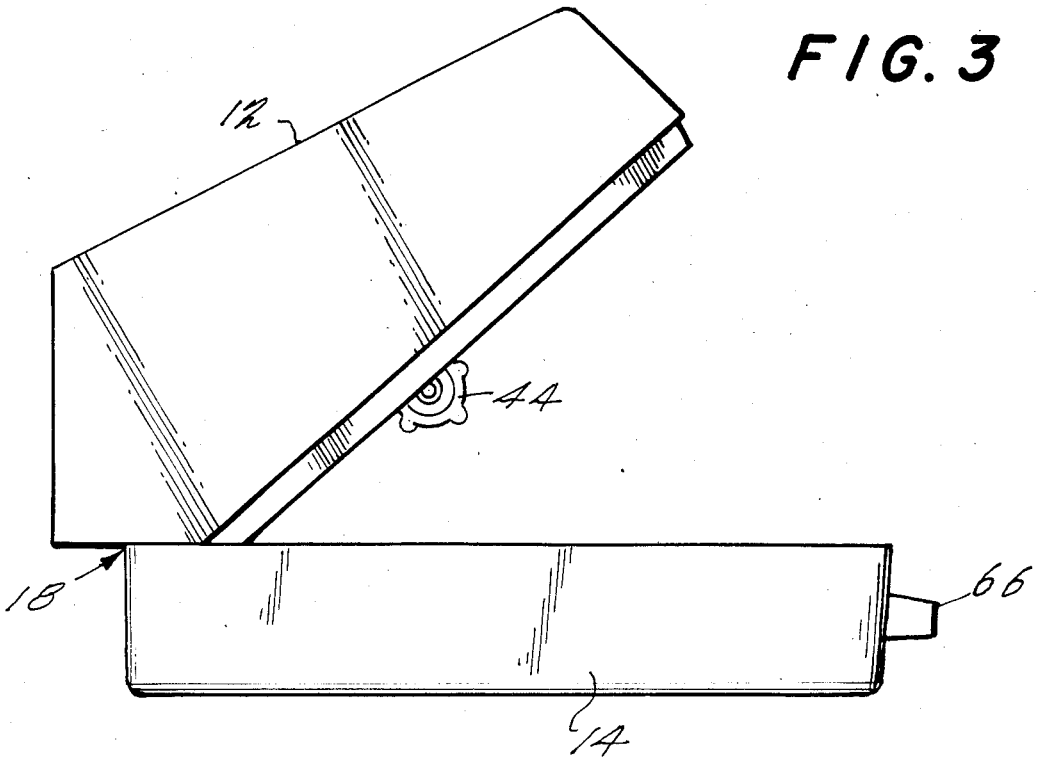
FIG. 3 is a general side view of the exemplary embodiment.

In the exemplary embodiment, all of the mechanically driven components, including the tractor drive 44 are carried by the upper housing member 12. The electronic printer controller may be housed where convenient. As depicted in FIG. 2, the printer controller might comprise two printer circuit boards, one of which (board number 1) is mounted in the lower housing member 14 while the other (printer control board number 2) may be mounted in the upper housing member 12. Multiconductor cabling 56 may then be routed around the interior edges of the printer housings and in proximity with the rotational point 16 so as to interconnect the printer controller boards, the various drive motors 54, wire driving electromagnets and the print head 38, the carriage drive, etc.

A transparent section 60 is also preferably provided so as to permit viewing of the print station area (or at least a view of the line that has just previously been printed) before the paper exits from slot 34. In addition, a sharp edge 62 may be provided in the transparent member 60 along the front of the exit slot 34 so as to provide a convenient tear off position for paper that has previously been printed (this is especially useful for the continuous form paper 50 as will be appreciated).

Figure 5:
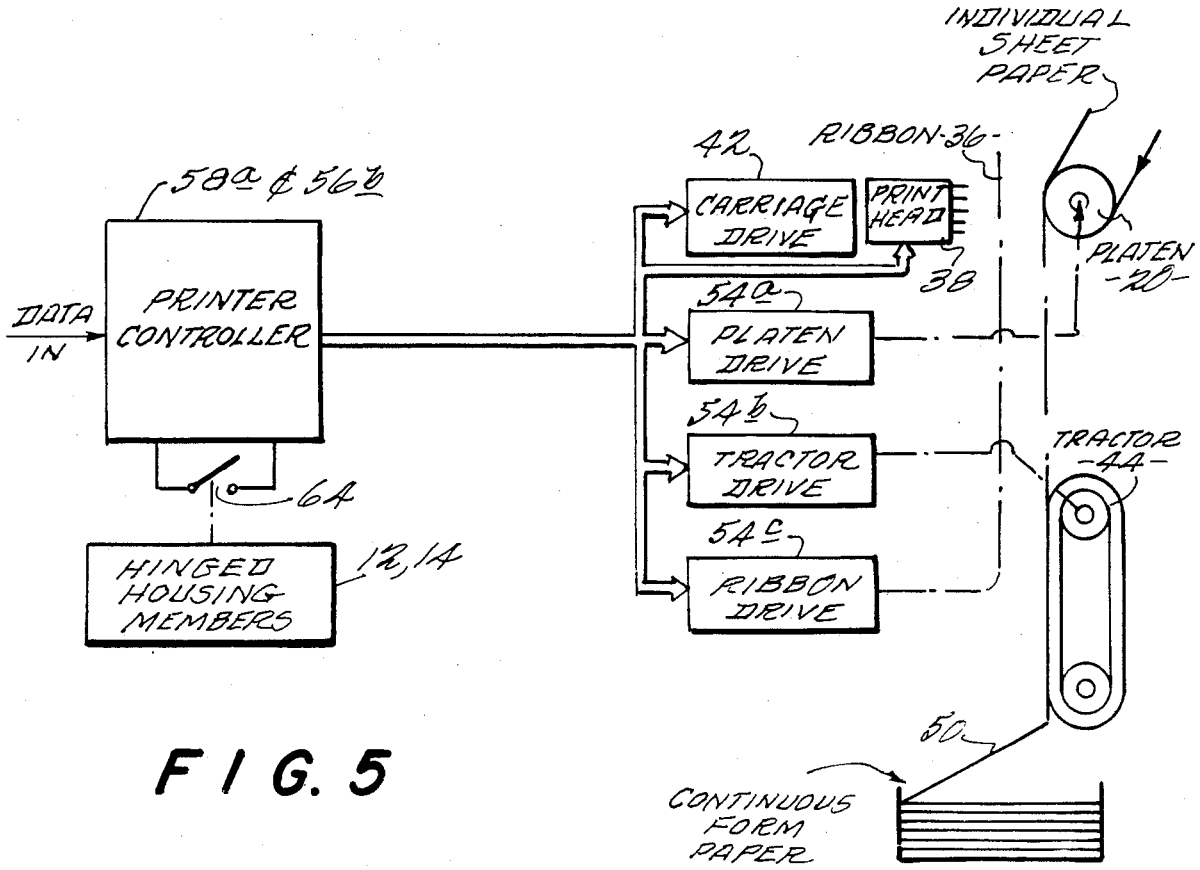
FIG. 5 is a schematic diagram of the electrical/mechanical control and drive mechanisms.

As schematically depicted in FIG. 5, the printer controller 58a, 58b may be connected to a convenience switch 64 that is actuated to a predetermined opened or closed position whenever the hinged housing members 12, 14 are opened such that the printer controller can be conditioned to automatically cease any printing operation whenever the housing members are rotated away from the closed position. One possible location for such a switch 64 is also depicted schematically in FIG. 2. The printer controller may also accept plug in font control modules 66 so as to permit convenient operator control of the printing font. The usual operator control switch panel 68 is also provided and interconnected via multiconductor cabling 56 to the appropriate printer control boards. A manual drive knob 70 may also be provided for the platen 20.

As should now be appreciated, when the printer housing is rotated to its normal operative closed position, the tractor drive mechanism 44 is completely out of sight and out of the way. Nevertheless, it conveniently may be accessed for paper loading operations by merely rotating the upper housing upwardly and rearwardly to its opened position because the tractor drive 44 is also carried by the rotatable upper housing member and depends therefrom so as to provide ready access when the housing members are rotated to the open position.

Although only one exemplary embodiment of the invention has been described in detail, those skilled in the art will recognize that many modifications and variations may be made in this embodiment while yet retaining many of the novel features and advantages of this invention. Accordingly, all such variations and modifications are intended to be included within the scope of the appended claims.

What is claimed is:

1. A printer comprising:

an external lower housing member; and an external upper housing member disposed above and rotatably secured in a closed position to said lower housing member;

said external upper housing member having affixed thereto a printing mechanism and a paper drive mechanism collectively including i. a platen; and ii. a tractor drive, said tractor drive being disposed below said platen and having an accessible portiond depending from said upper housing into said lower housing in said closed position, means to enable paper loading access when said upper housing member with said printing mechanism and said paper drive mechanism is rotated upwardly to an open position with respect to said lower housing member, the angular separation of said external upper and lower housing members defining an access region in said open position, said accessible portion of said tractor drive being disposed in said access region when the housing members are in the open position.

2. A printer as in claim 1 wherein:

said upper housing member and said lower housing member each include a forward section disposed forwardly of said rotatable securement and a smaller rear section disposed rearwardly of the rotatable movement, said upper and lower housing members dimensioned to be substantially angularly separated relative to each other at the rear section such that said upper and lower rear sections are normally separated from each other when the forward sections are closed upon one another and close towards each other as the forward sections open to a paper loading position whereat said tractor drive depends from the raised forward section of the upper housing member for easy access.

3. A printer as in claim 2, wherein said rotatable securement comprises a hinge securing the upper and lower housing members at a location generally intermediate said forward and rear sections and at a lower portion of the lower housing member substantially removed from a parting line defined by adjacent side edges of said upper and lower housing members when in a closed position.

4. A printer as in claim 1 wherein said lower housing member contains an opening to admit continuous form paper from an external source.

5. A printer as in claim 2, wherein nsaid lower housing member contains an opening to admit continuous form paper from an external source.

6. A printer as in claim 5 wherein said rotatable securement comprises a hinge securing the upper and lower housing members but sufficiently displaced toward the lower rear area of the lower housing member to provide added opening of said upper housing member relative to said lower housing member to facilitate access for loading of continuous form paper into the tractor drive.

7. A printer as in claim 1 further comprising means to disable printing when said upper and lower housing members are moved from a closed to an opened position.

8. A printer as in claim 6 further comprising means to disable printing when said upper and lower housing members are moved from a closed to an opened position.

9. A printer as in claim 1 further comprising means for directing individual form paper downwardly into said platen from a slot in the top of said upper housing member.

10. A printer as in claim 8 further comprising means for directing individual form paper downwardly into said platen from a slot in the top of said upper housing member.

11. A printer as in claim 1 wherein said upper housing member further includes a viewing aperture to allow viewing of the paper as it is being printed.

12. A printer as in claim 11 wherein said viewing aperture includes a transparent covering and said upper housing and covering are slanted upwardly to facilitate viewing of said paper.

13. A printer according to claim 1, wherein:

said upper and lower housings are substantially alinged but angularly configured inwardly in non-abutting relationship with respect to one another at their rear parting lines, and said upper and lower housings being rotationally hinged substantially below said parting line so as to facilitate rotation upwardly and rearwardly with respect to said lower housing into abutting relationship to provide additional opening access for loading record medium.

14. A printer according to claim 13 wherein:

said exit opening is located in a portion of said upper housing and provided with a transparent cover, said transparent cover and upper housing portion being slanted upwardly towards the rear of the upper housing to facilitate reading of the information being printed ons aid record medium.

15. A printer cable of alternately driving individual or continous forms through a printing station, said printer comprising:

an external lower housing member including at least a portion of an electronic printer controller; and an external upper housing member including the following elements fixedly attached thereto, said elements being attached to said external upper housing member such that rotation of said upper member results in the rotation of said elements:

i. a driven cylindrical platen with paper input guide means for feeding individual sheet forms downwardly against a rear side of the platen and paper output guide means for feeding paper upwardly past a front side of the platen;

ii. a print head assembly disposed opposite the from side of said platen for thereat printing inidica onto paper; and iii. a continuous form drive assembly disposed below said platen and depending from said external upper housing member for feeding continuous form upwardly into engagement with the from side of said platen;

said printer controller being electrically connected to controllably drive said platen, said print head assembly and said continuous form drive.

16. A printer for printing on continuous-form paper or individual form paper comprising:

an external upper housing and an external lower housing, each of said housings including a major area forward portion and a related substantial but small area rear portion, the related rear portions of each of said upper and lower housings being hinged with respect to one another and angularly separated with respect to one another when the major forward portions are rotated to a closed normally operative printer position and the location of angling enabling said forward portions to rotate away from one another to an open access position to load paper into said printer and to rotate towards one another to a closed position during printing, said upper forward portion having affixed thereto a platen, a carriage carrying printing continuous-form paper, means for engaging said continuous-form paper to a first side of said platen, means for admitting individual form paper and engaging it to a second side of said platen, and means for driving said carriage and printing elements.

17. A printer according to claim 16 further comprising means to disable printing when said forward portions are rotated from their closed position.

18. A printer according to claim 16 wherein said hinging is displaced from said location of angling to provide a component of translational motion of said upper housing relative to said lower housing to increase the size of said opening in the continuous form loading position and thus to facilitate access for loading of said continous form paper.

19. A printer with multiple record medium paths comprising:

an external lower hosing, an external upper housing disposed above and rotatably cooperating with said lower housing, a platen, a print head disposed adjacent said platen, first record medium feed means and an associated record medium admittance opening supplying a continuous form record medium to said platen along a first path for movement past said print head, second record medium feed means and an associated record medium admittance opening for supplying individual form record media to said platen along a second path for movement past said print head, an exit opening for exiting said supplied record media, means for causing said print head to respond to applied input information for printing such applied information onto said supplied record media before causing said supplied paper to exit said exit opening.

said platen, print head, first record medium feed means and second record medium feed means all being affixed to said external upper housing and said upper housing being rotatable to a downward position with respect to said lower housing, said platen, print head, first record medium feed means and said second record medium feed means being affixed to said external upper housing such that rotation of said upper housing results in the rotation of said platen, print head, first record feed means and said second record medium feed means, means for enabling paper loading access to said printer comprising said external upper housing and its affixations being rotatable to an upward position with respect to said external lower housing whereat said first record medium feed means is disposed below said platen and depending from said external housing.

20. A printer according to claim 19 wherein said admittance openings for said first and second record medium feed means and said exit opening are separate openings.

21. A printer according to claim 20 wherein one of said separate openings and said exit opening are located in the upper housing.

22. A printer according to claim 19 wherein said exit opening is located in the upper housing and positioned to cooperate with a dependent portion of said first record feed means.

* * * * *